US006343405B1

(12) United States Patent
Carson

(10) Patent No.: US 6,343,405 B1
(45) Date of Patent: Feb. 5, 2002

(54) DOOR CLOSURE MECHANISM

(75) Inventor: Timothy Burton Carson, Thousand Oaks, CA (US)

(73) Assignee: Anthony, Inc., San Fernando, CA (US)

( * ) Notice: Subject to any disclaimer, the term of this patent is extended or adjusted under 35 U.S.C. 154(b) by 0 days.

(21) Appl. No.: 09/166,479

(22) Filed: Oct. 5, 1998

(51) Int. Cl.[7] ..... E05F 1/08

(52) U.S. Cl. ..... 16/308; 16/307; 16/304; 312/138.1; 312/139

(58) Field of Search ..... 16/308, 307, 304, 16/780, 277; 312/116, 138.1, 139, 326, 329

(56) References Cited

U.S. PATENT DOCUMENTS 962,426 A * 6/1910 Hansen ..... 16/308
1,126,067 A * 1/1915 Nolte ..... 16/308
4,696,078 A 9/1987 Stromquist
4,905,347 A * 3/1990 Worth ..... 16/308
5,321,870 A * 6/1994 Wada et al. ..... 16/308
5,333,355 A * 8/1994 Beswick et al. ..... 16/308
5,687,509 A * 11/1997 Barroero et al. ..... 16/308

* cited by examiner

*Primary Examiner*—Anthony Knight
*Assistant Examiner*—Mark Williams
(74) *Attorney, Agent, or Firm*—Henricks, Slavin & Holmes

(57) ABSTRACT

A door closure mechanism is described including a base and a resilient element wherein the base includes surfaces which converge toward each other and wherein the resilient element, such as a torque rod, engages the converging surfaces so that the torque rod is more securely held in the base.

8 Claims, 3 Drawing Sheets

42
46
48
50
52
54
56
58
60
62
64
66
68
70
44

DOOR CLOSURE MECHANISM

BACKGROUND OF THE INVENTION

1. Field of the Invention

This invention relates to door closure mechanisms, for example torque rod torsion mechanisms for swing doors.

2. Related Art

Door closure mechanisms are common features for automatically closing a door and/or insuring an adequate seal between the door and the surrounding door frame. For example, swing doors often include automatic closure mechanisms to return the door to its original closed position after the door is released. For such doors as commercial refrigerator doors, used in supermarkets, convenience stores and the like, door closure mechanisms are used to return the door to the closed position after a customer has viewed and/or selected product from the case. After the customer releases the door, the closure mechanism moves or biases the door to its original positioned in the surrounding door frame. Typically, a magnetic gasket strip and magnetic plate form a seal between the door and the surrounding frame. The closure mechanism contributes to insuring an appropriate seal between the door and the surrounding frame.

Commercial refrigerator doors typically use a torsion or torque rod mechanism for closing the swing doors. The torque rod mechanism is an assembly of a spring steel or other torsion rod and a base that one end of the torsion rod is attached to. The base serves as a reference point stationary relative to the surrounding frame for the torsion rod, so that opening of the door applies torque to the torque rod. The base also properly positions the torque rod assembly in a vertical door frame element end may also serve as a lower door hinge pin. The second end of the torque rod is anchored to the door so that opening the door will twist the torque rod between the second end and the base supported by the surrounding frame. Anchoring the second end in the door may be accomplished by bending the second end at a 90 degree angle relative to the remainder of the torque rod. The bent second end may be placed in a holding block and inserted into a hollow portion of a vertical door frame element of a vertical swing door. One type of door closure mechanism for swing doors is shown and described in U.S. Pat. No. 4,696,078 by Stromquist, issued Sept. 29, 1987, entitled "Combined Adjustable Door Hinge Pin Socket And Adjustable Torque Rod Anchor Device", incorporated herein by reference.

The base and torque rod are typically separate parts joined together to form an assembly where the torque rod is fixed to the base. In one configuration, the base is a molded or die cast aluminum part having a square opening extending straight through the center for accepting the square first end of the spring steel torque rod. Sufficient clearance is provided between the inside surface of the base and the external mating surface of the torque rod to permit insertion of the torque rod in the base with sufficient ease to minimize the time required for assembly of the base and torque rod. One surface of the base is then peened on opposite sides of the torque rod to push adjacent portions of the base against the corresponding surfaces of the torque rod.

Occasionally, the base may crack or break in such a way that the torque rod is no longer securely fixed in the base. Consequently, the bias provided by the torque rod is lost. It is possible that stresses are developed in the molded aluminum base as a result of the torsion developed in the torque rod, which may be aggravated by impurities in the base or by stresses, such as by excessive peening.

SUMMARY OF THE INVENTION

A door closure mechanism is described which provides a more reliable assembly and which is more easily manufactured. It also reduces the possibility of failure of the door closure mechanism. In one preferred embodiment, the door closure mechanism includes a base and then opening in the base defined by surfaces which converge toward each other. A resilient element such as a torque rod engages and mates with the opening in such a way as to fix the torque rod in the base. Preferably, the torque rod has a square cross-section and the opening in the base is a square opening, and the opening includes a draft so that the engagement between the torque rod and the opening becomes tighter as the torque rod extends further into the base.

In further preferred embodiment so the invention, the opening in the base is defined by four walls oriented at right angles with respect to each other, and the torque rod has a square cross-section. As in conventional torque rods, the torque rod is made of spring steel. The four walls of the base extend from one surface of the base longitudinally parallel to an axis of the base to a corresponding set of inwardly angled walls, which may be formed as chamfered surfaces. The chamfered surfaces may be formed as a draft in the opening. The chamfered surfaces serve to partially neck down the inserted end of the torque rod, thereby fully seating the torque rod in the base.

These and other features of the invention will be more fully understood after considering the drawings, a brief description of which is set forth below, and the following detailed description of the preferred embodiments.

DETAILED DESCRIPTION OF THE PREFERRED EMBODIMENTS

The present invention provides a more reliable closure mechanism which is more easily manufactured. The closure mechanism also reduces the possibility of failure of the closure mechanism.

Figure 1:
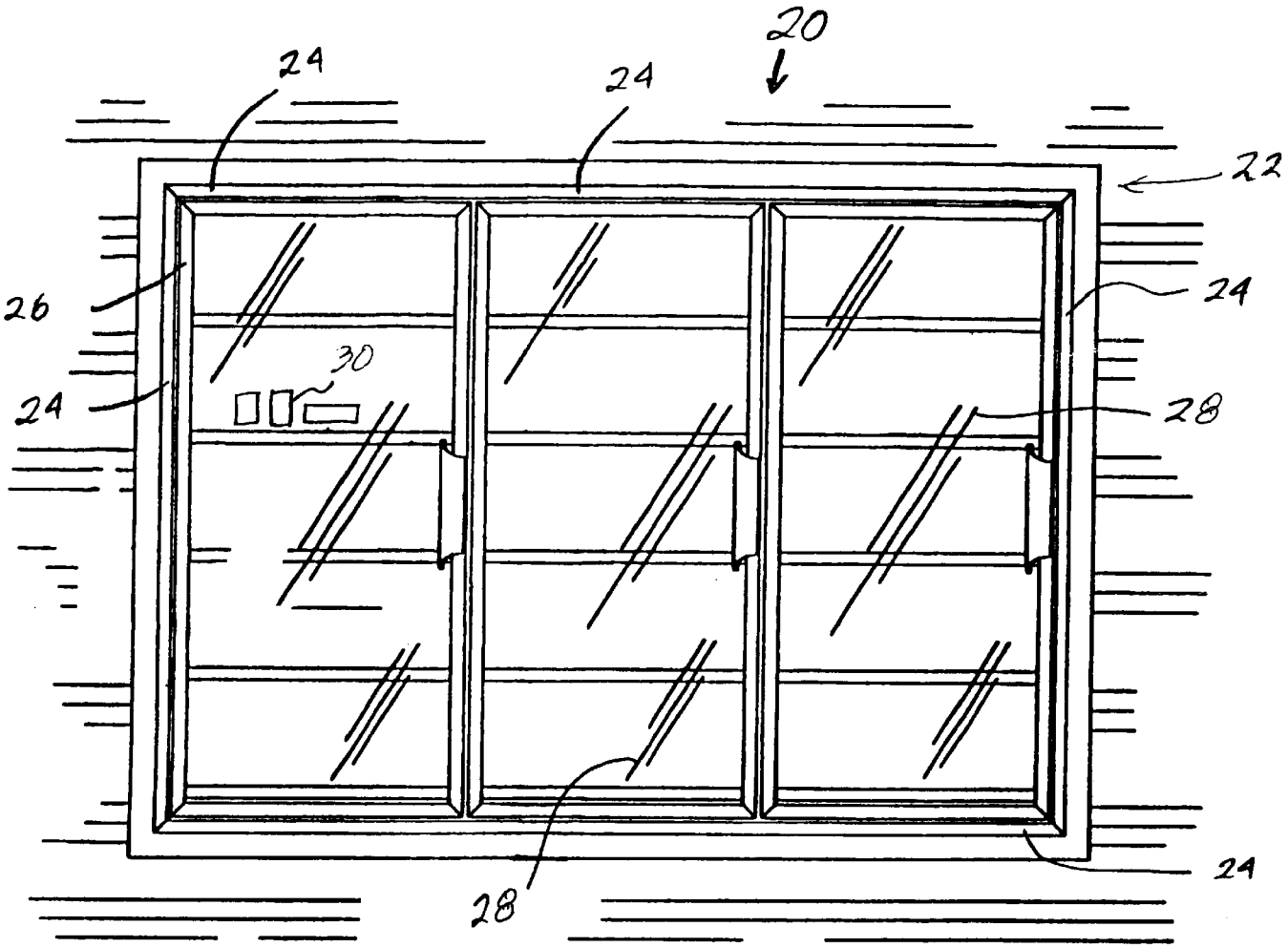
FIG. 1 is a front elevation view of the refrigerated display case including swing doors in which a closure mechanism of the present invention can be used.

In the context of refrigerated display cases 20 (FIG. 1), a cabinet has a frame 24 surrounding and supporting a number of doors 26. The doors 26 typically include glass panels 28 to permit viewing a product 30 inside the display case and to permit access to the product 30.

The doors 26 may be swing doors and typically include closure mechanisms for automatically closing the doors to their original positions in the surrounding door frames. For example, in supermarkets or convenience stores, customers will open the door to inspect or select a product, after which the customer releases the door. The automatic door closure mechanism biases the door closed in the surrounding door frame. The closure mechanism also helps to insure a proper seal between the door and the surrounding frame. In conventional multi-pane glass doors, the door frames have a groove, channel or other passage way into which various components and parts may be placed. On the hinge side of the door, a closure mechanism can be placed in the passage way so as to be hidden from view. The closure mechanism may also serve a dual function by supporting the door for swinging movement.

Figure 2:
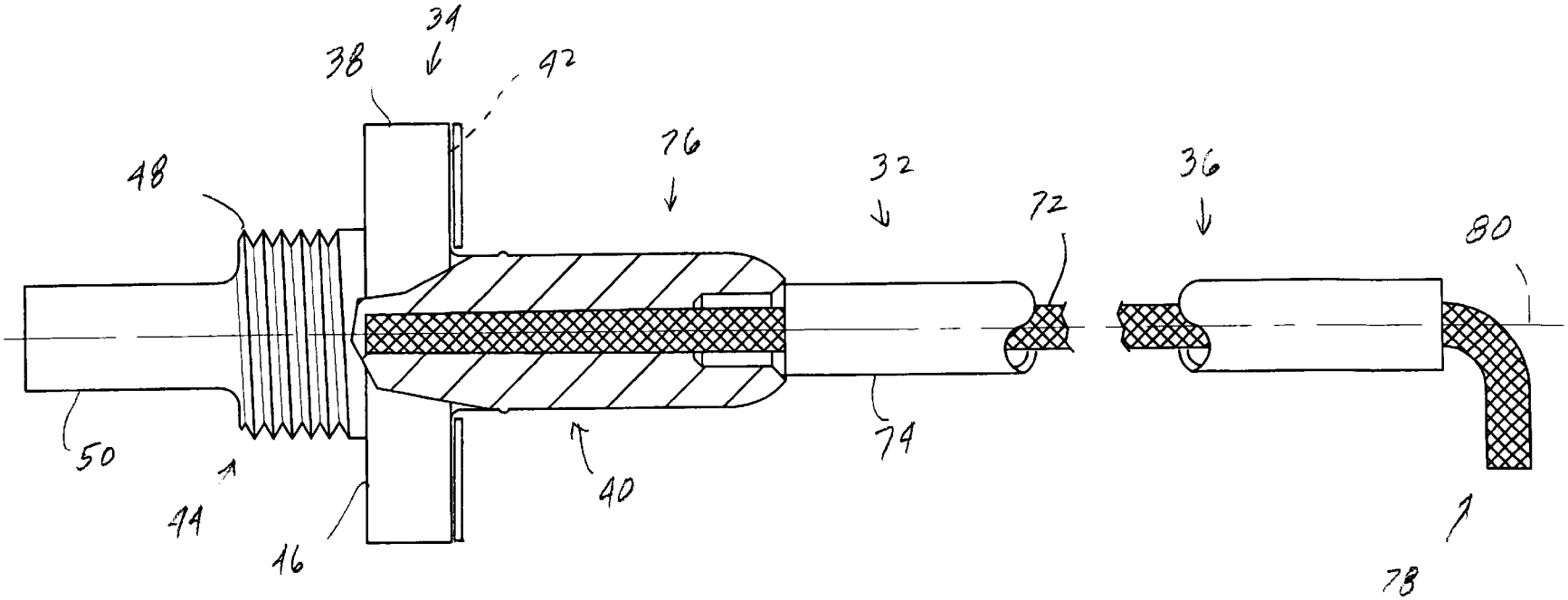
FIG. 2 is a plan view and partial sections and partial cutaway view of a closure mechanism in accordance with one aspect of the present inventions.

A closure mechanism such as a torque rod assembly 32 (FIG. 2) may include a base 34 and a torque rod 36. The base 34 may be a conventional base on the outside, and may include a round disk 38 or a rectangular, hexagonal or other flatted disk forming the middle portion of the base. The base in the configuration described herein includes a round disk 38, but it should be understood that other disk configurations can be used without departing from the spirit and scope of the invention. A post 40 extends from a first side 42 of the disk 38 and a shaft 44 extends from a second side 46 of the disk 38. The shaft is threaded with threads 48 from a position adjacent the second surface 46 to an approximate mid-portion of the shaft 44. The remainder of the shaft 44 has a reduced dimension square shaft 50.

The post 40 includes a substantially cylindrical body 52 extending longitudinally about an axis 54 (FIG. 3) extending through the center of the base 34. A thrust bearing or a plastic washer 55 can be placed over the body 52 and placed against the surface 42 for supporting a door and for allowing the door to swing smoothly, as is conventional. The post preferably includes a ridge 56 or series of bumps or raised lines extending circumferentially about a portion of the post adjacent but spaced apart from the first surface 42 of the disk 38. The ridge 56 helps to maintain the base in an opening in a corner key or other door element. The post also includes a first central channel or bore 58 extending longitudinally of the post and into the disk 38. A counter bore 60 extends from a chamfered surface 62 at the opening of the bore at the first or far end of the post 64 to a chamfered surface 66 at the opposite end of the counter bore 60 from the first chamfered surface 62. The second chamfered surface 66 connects the counter bore 60 to the central bore 58. The outside surface 68 of the post 52 curves inwardly to the chamfered surface 62.

Figures 3, 4, 5:
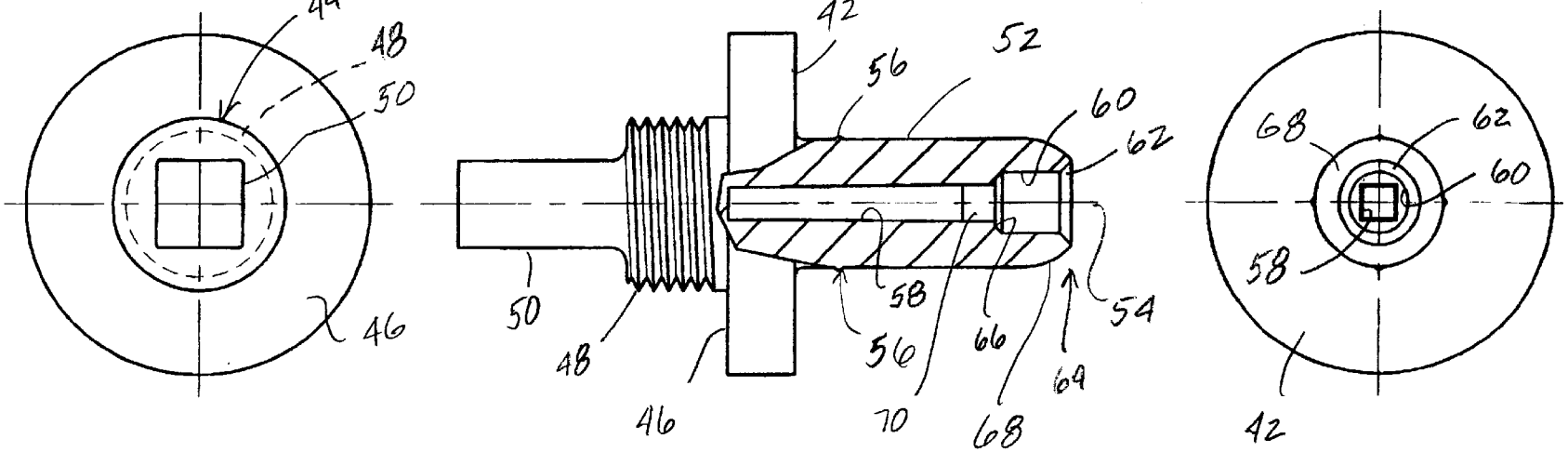
FIG. 3 is a side elevation and partial cutaway view of a base for use with the closure mechanism of the present inventions.
FIG. 4 is a right side view of a base for use with the closure mechanism of the present inventions.
FIG. 5 is a left side view of a base for use with the closure mechanism of the present inventions.

The central bore 58 includes a transition bore 70 which has substantially flat, straight walls forming a square opening between the chamfered surface 66 and the central bore 58. The central bore 58 then extends from the transition bore 70 substantially to the second surface 46 of the round disk 42 and forms a bore having a substantially square cross-section over the length of the central bore from the chamfered surface 66 to the second surface 46 of the round disk. However, the first, second, third and fourth walls forming the square central bore converge toward each other longitudinally in a direction along the axis 54 from the chamfered surface 66 to the second surface 46 on the round disk. The converging surfaces constitute a draft in the central bore to more fully engage, hold and secure an end of a square, rectangular or other shaped torque rod in the base 34. The first, second, third and fourth surfaces together form surfaces extending from the transition bore 70 toward the square shaft 50 or the other end of the base. The central bore 58 extends from a first end adjacent the chamfered surface 66 to second surface 46, thereby converging toward each other from respective first ends near the chamfered surface 66 toward the second end, namely the second surface 46. As shown in FIGS. 3 and 4, the surfaces in the central bore 58 are preferably flat surfaces oriented at 90 degrees relative to each of the adjacent surfaces forming a square opening in the post 52. While the opening is preferably square in cross-section, and having substantially straight walls extending longitudinally, the walls forming the central bore 58 can take other configurations, to converge toward each other as they approach the second surface 46.

The conventional torque rod 36 preferably includes a square or rectangular spring steel shaft 72 encased in a plastic or other cover 74 and extends from a first end 76 to a second end 78. The second end 78 is preferably bent at 90 degrees to the central axis 80 so as to engage a block or other positioning element (not shown), as is known in the art.

The first end 76 of the torque rod preferably extends into and is securely held by the central bore 58 of the base 34. The first end 76 of the torque rod is preferably formed of substantially straight walls that do not converge or curve relative to each other. Therefore, when the base 34 is press fit onto the first end of the torque rod, the draft on the central bore 58 progressively engages the first end of the torque rod 76 so as to more tightly and securely hold the torque rod in the base. This method of securing the torque rod to the base distributes the forces holding the torque rod more evenly over the engagement surface between the base and the torque rod, thereby minimizing the creation of localized or focused forces within the base which may cause fracture or failure of the torque rod assembly. While the central bore 58 includes the draft surfaces and the first end 76 of the torque rod is substantially straight, it should be understood that other configurations are possible to achieve the desired engagement and stable holding of the torque rod in the base.

While preferred embodiments of the present inventions have been described herein, it should be understood that other configurations can be used while still falling within the scope of the present inventions. Numerous changes in modifications can be made to these preferred configurations without deviate in from the inventions. The inventions are limited only by the following claims.

What is claimed is:

1. A door closure mechanism comprising:

a base having a first surface configured to be received in a portion of a door and a second surface configured to be received in a portion of a stationary support for the door, at least third and fourth surfaces extending from the first surface toward the second surface wherein each of the third and fourth surfaces include first and second ends and wherein the third and fourth surfaces converge toward each other from the respective first ends toward the second ends; and a resilient element having a first end and a second end, the first end having at least first and second surfaces for mating with and engaging the at least third and fourth surfaces in the base.

2. The door closure mechanism of claim 1 wherein the at least third and fourth surfaces of the base are positioned at right angles relative to each other.

3. The door closure mechanism of claim 2 further comprising fifth and sixth surfaces forming a square opening with the third and fourth surfaces.

4. The door closure mechanism of claim 3 wherein the resilient element includes a torque rod element having a square cross-section.

5. The door closure mechanism of claim 1 wherein the base includes a round disk and a substantially round post extending from the disk to a first post end and wherein the at least third and fourth surfaces are formed in the first post end and extend toward the disk.

6. The door closure mechanism of claim 5 wherein the post includes a first chamfered surface in the first post end and wherein each of the at least third and fourth surfaces extend from the chamfered surface to respective draft surfaces in the post.

7. A door closure mechanism comprising:

a base having a first surface configured to be received in a portion of a door and a second surface configured to be received in a portion of a stationary support for the door, four walls defining a square opening extending from the first surface toward the second surface, wherein the four walls include a draft; and a resilient element having a first end and a second end, the first end having a square cross-section for mating with the square opening in the base.

8. A door closure mechanism comprising:

a base having a first surface configured to be received in a portion of a door and a second surface configured to be received in a portion of a stationary support for the door, a plurality of walls defining an angled opening extending from the first surface toward the second surface and wherein the plurality of walls extend from the first opening toward the second opening at an angle relative to each other; and a torque rod having a first end and a second end, the first end having a cross section having an angled configuration and engaging in the angled opening in the base and wherein the angled cross-sectional configuration extends longitudinally of the torque rod at an angle different from the angled opening of the base.

* * * * *